United States Patent [19]

Behlert

[11] Patent Number: 4,691,461

[45] Date of Patent: Sep. 8, 1987

[54] ADJUSTABLE GUN TRIGGER MECHANISM

[76] Inventor: Austin Behlert, R.D. #2, Box 63, Pipersville, Pa. 18947

[21] Appl. No.: 917,919

[22] Filed: Oct. 14, 1986

[51] Int. Cl.[4] ..... F41C 19/02

[52] U.S. Cl. ..... 42/69.01

[58] Field of Search ..... 42/69.01, 69.02, 69.03

[56] References Cited

U.S. PATENT DOCUMENTS

| | | | |
|---|---|---|---|
| 1,184,950 | 5/1916 | Hammond | 42/69.02 X |
| 1,909,425 | 5/1933 | Reid | 42/69.01 |
| 4,553,347 | 11/1985 | Jackson | 42/69.01 |

*Primary Examiner*—Deborah L. Kyle
*Assistant Examiner*—Ted L. Parr
*Attorney, Agent, or Firm*—Gregory J. Gore

[57] ABSTRACT

A trigger mechanism permits the adjustment of trigger pull quickly and easily from the exterior of a handgun over a wide range of adjustment. A double trigger arrangement includes a means for moving a contact point between a front pivot trigger and the heel or face portion of a cooperating slide trigger so that the mechanical advantage between the first trigger and the firing mechanism can be varied. Adjustment may be achieved through the use of simple set screws fitted into the front pivot trigger which may be adjusted with simple tools. In an alternate embodiment, the contact point between the pivot trigger and the slide actuator can be changed by interchanging replaceable trigger shoes, each trigger shoe having a contact projection of a different location.

6 Claims, 6 Drawing Figures

ADJUSTABLE GUN TRIGGER MECHANISM

FIELD OF THE INVENTION

This invention relates to firearms, in particular to trigger mechanisms used in automatic handguns.

BACKGROUND OF THE INVENTION

In a conventional automatic handgun, a trigger is provided with a related mechanism which controls and releases a spring-loaded firing pin. Mostly due to the automatic nature of this firearm, the trigger pull is extremely heavy and has a set poundage which is required by the firing mechanism spring. For certain applications, such as target shooting, it is desirable to use a very light trigger pull, being less than the conventional seven-pound pull and closer to a one or two-pound pull. Furthermore, it is often desired to adjust the trigger pull to a particular setting which may vary greatly between different persons shooting the firearm.

Prior art examples of firearms with selective trigger pull employ complicated mechanisms which are not adjustable and which allow for only two alternative trigger pull settings. A recent example is disclosed in the U.S. Pat. No. 4,005,540 to Robinson.

SUMMARY OF THE INVENTION

The present invention includes a novel trigger assembly which allows the trigger pull of an automatic handgun of the type depicted in the drawings shown below or other firearms to be adjusted. The adjustment is achieved external to the firing mechanism and body of the firearm and may vary the trigger pull over a wide range without the need for complicated mechanisms.

More specifically, the present invention includes a pivoting trigger cooperating with the conventional slide trigger (hereinafter called "slide actuator") found in automatic handguns. The trigger and slide actuator are mechanically related through the frictional force transmitted at the back portion of the pivot trigger, cooperating mechanically as a cam and follower. A protruding contact pin in the back of the trigger establishes a point of contact with the heel of the slide actuator. By selectively moving the point of contact in relation to the trigger pivot axis, the mechanical leverage acting upon the slide actuator and firing mechanism may be altered. Furthermore, the heel of the slide actuator may be angled so that the trigger point of contact can be moved without altering the position of the trigger at rest.

Moving the slide actuator contact point may be achieved in a variety of ways. In one embodiment, simple contact pins in the form of set screws are used to establish a protruding point of contact through the back of the trigger. This allows a number of different trigger pulls depending upon the number of set screws used. Each set screw allows a different contact point to be selected along the back of the trigger, thereby establishing different degrees of trigger pull.

In another embodiment of the present invention, an eccentric cam is fitted to the trigger which protrudes from its back surface. By selectively rotating this cam, an infinite number of contact points can be achieved and therefore the trigger pull may be very finely adjusted.

In yet another embodiment of the present invention, a trigger shoe is fitted over the front pivot trigger which has a fixed contact pin located on the back side of the shoe to establish the desired trigger pull. Interchanging different shoes can vary the trigger pull.

One of the novel and unique aspects of the present invention is that the trigger pull adjustment can be achieved as described above by making changes external to the rest of the firing mechanism and body of the firearm. This means that changes in trigger pull may be adjusted quickly and conveniently with simple tools. No other mechanism known in the art of firearm trigger mechanisms provides this convenience or degree of adjustability.

It is therefore the object of the present invention to provide an adjustable trigger mechanism to vary the amount of trigger pull in a manner such that the adjustment may be made quickly and easily over a wide range of adjustment.

DESCRIPTION OF THE PREFERRED EMBODIMENT

Figure 1:
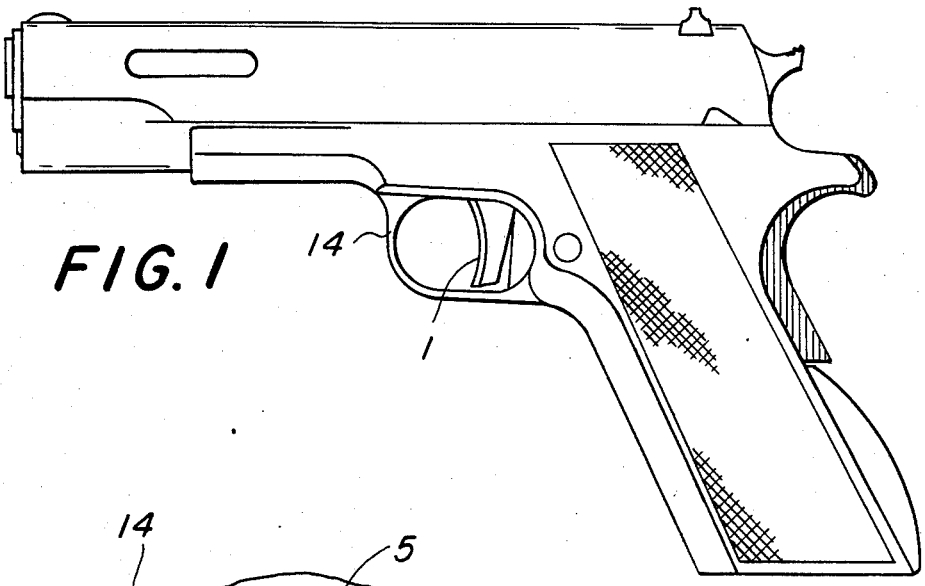
FIG. 1 is side elevation of a firearm having a trigger mechanism employing the invention.

Referring to FIG. 1, an automatic handgun is shown which includes the present invention. The trigger design as can be seen from the drawing does not alter the conventional position of trigger 1 within trigger housing 14.

Figure 2:
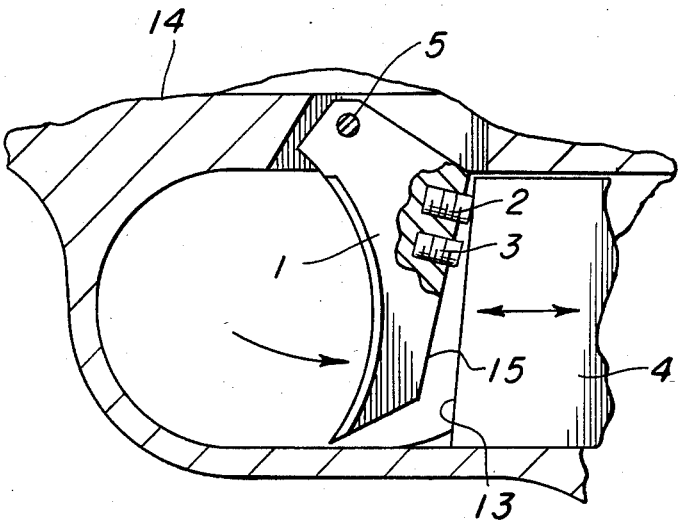
FIG. 2 is a sectional view of one embodiment of the present invention taken from FIG. 1.

FIG. 2 shows an enlarged view of one embodiment of the present invention. Front trigger 1 includes two set screws 2 and 3 for contacting the slide actuator 4 different distances from pivot pin 5. Set screws 2 and 3 are arranged at different distances from pivot pin 5. The slide actuator is restricted to translational motion or linear travel within the trigger housing 14. When used as alternate points of engagement with slide actuator 4, a different mechanical advantage of the trigger is selected.

It is a unique feature of the present invention that the trigger pull may be adjusted without necessarily changing normal trigger position unless desired. The proper angle of the slide actuator heel 13 ensures this feature. It should be appreciated by those skilled in the art that while the normal trigger at rest will not change, the distance of travel of the pivot trigger will increase as lighter trigger pull settings are achieved. Furthermore, the distance of travel required by slide actuator 4 between rest and firing positions will always be the same.

Referring again to FIG. 2, if a lighter trigger pull is desired, set screw 2 is extended to contact rear slide actuator 4 and to take up the play between the elements. The set screw 3 is simultaneously retracted to a position where it does not extend beyond the back portion 15 of pivot trigger 1. In this setting, set screw 2 is operational only. Likewise in a alternate setting, set screw 2 is retracted so that it does not project beyond the back portion 15 of the pivot trigger. Set screw 3 is extended beyond the back of the trigger so that it becomes the sole contacting element with slide actuator 4.

Figure 3:
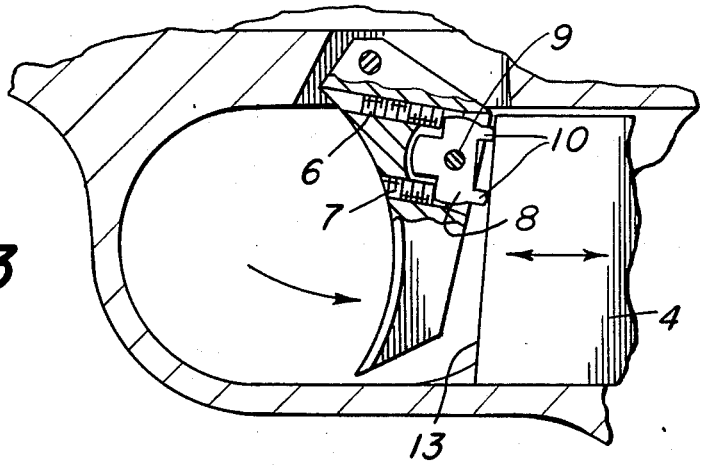
FIG. 3 is a sectional view of FIG. 1 showing an alternate embodiment of the present invention.

Referring to FIG. 3, an alternate embodiment of the present invention is shown which allows a continuous variation of adjustment between two extremes, whereas the embodiment of FIG. 2 allows for only two alternate settings. This embodiment contains set screws 6 and 7 which cooperate with eccentric cam 8 so that the cam may be locked securely at a particular point of rotation with respect to axis 9. Cam 8 contains one or more projections 10 which establishes the contact point between the trigger and the heel of the slide actuator. It may be appreciated by those skilled in the art that the shape and dimension of these components and, in particular, the heel of the slide actuator may be devised so that the mechanical advantage between the pivot trigger and slide actuator is altered without changing the trigger position at rest.

Figure 4:
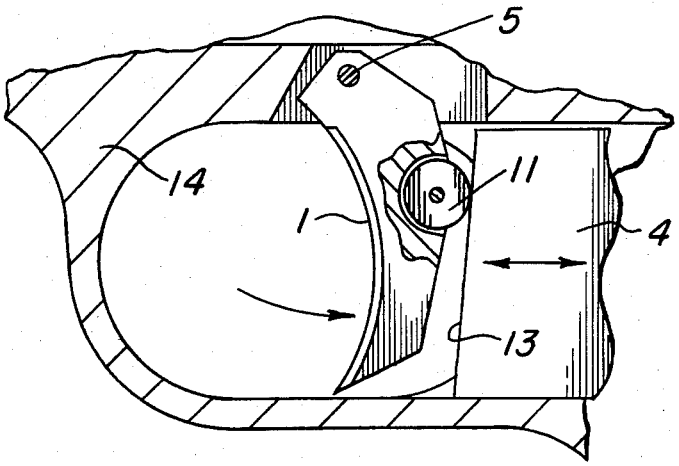
FIG. 4 is a sectional view of FIG. 1 showing an embodiment of the present invention.

FIG. 4 shows an embodiment of the present invention wherein the mechanical advantage and trigger pull between pivoting trigger 1 and slide actuator 4 is selected by interchanging different triggers which may be replaced by removing pivor pin 5. In this embodiment, roller bearing element 11 has been added to reduce the friction for smoother actuation.

Figure 5:
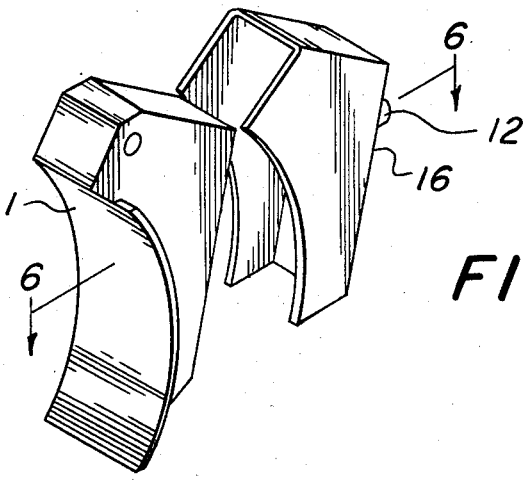
FIG. 5 is an isometric view of an alternate embodiment of the present invention.

As an alternative to replacing the entire trigger, FIG. 5 shows yet another embodiment of the present invention wherein the contact point of the pivot trigger 1 may be changed by adding different trigger shoes 16, each shoe having a different contact projection 12 affixed thereto to change the contact point.

Figure 6:
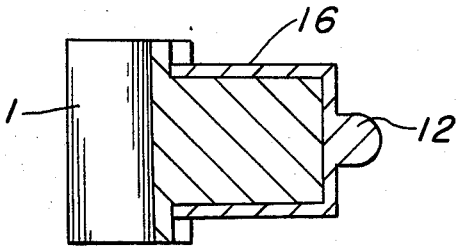
FIG. 6 is a sectional view taken from FIG. 5.

FIG. 6 is a sectional view of FIG. 5 showing the location of trigger shoe contact projection 12.

It may be readily appreciated from those skilled in the art that the various mechanisms shown in the drawings used to achieve the described changes in mechanical advantage between the front pivot trigger and the slide actuator may be easily achieved because the front trigger mechanism is substantially external to the body of the firearm. For instance, set screws 2, 3, 6, and 7 may be easily accessed and turned through apertures which project through the front of the trigger.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A firearm trigger mechanism, comprising:

a. a trigger housing, b. a trigger pivotably mounted to said trigger housing, said trigger having a back portion engaging a firing mechanism, c. a slide actuator connected to said firing mechanism having a front portion and movable only along a straight line of travel, d. a contact point located on the back portion of said trigger for contacting the front portion of said slide actuator, and e. means affixed only to said trigger for selectively moving the contact point along the length of the back portion of said trigger thereby changing the mechanical advantage between said trigger and said slide actuator to vary the trigger pull without moving the trigger.

2. The trigger mechanism of claim 2 wherein said means for selectively moving the contact point along the length of the back portion of said trigger comprises a plurality of interchangeable trigger shoes, each trigger shoe having a contact projection at a different location to selectively change said contact point with said slide actuator by exchanging trigger shoes.

3. A trigger mechanism for a firearm, comprising:

a. a trigger housing, b. a trigger pivotably affixed to said trigger housing, the trigger having a back portion for engaging a firing mechanism, c. a slide actuator being part of said firing mechanism and located in contacting relationship with the back portion of said trigger, said slide actuator having a front portion which contacts the back portion of said trigger when the trigger is pulled, and d. a plurality of pins threadably engaged with said trigger and selectively adjustable so that only one pin at one time contacts the front of said slide actuator, said pins being located at different points along the length of said trigger.

4. In a handgun having a trigger and a firing mechanism, the improvement comprising:

a. a trigger with a pivot point, said trigger engaging a slide actuator limited to a fixed straight line of travel, a contact point between said trigger and said actuator being selectively predetermined by adjustment of a plurality of projections through the back of said trigger which contains said slide actuator, said projections being affixed only to said trigger.

5. A firearm trigger, comprising:

a. a cam rotatably affixed to the back of said trigger, said cam containing an eccentric projection for engaging a firing mechanism, and b. means for selectively rotating said cam whereby the mechanical leverage between said trigger and said firing mechanism can be varied.

6. A trigger mechanism for a firearm, comprising:

a. a trigger housing, b. a trigger pivotably affixed to said trigger housing, the trigger having a back portion for engaging a firing mechanism, c. an actuator being part of said firing mechanism and located in contacting relationship with the back portion of said trigger, and d. a trigger extension affixed to said trigger and protruding from the back portion of said trigger, said extension being adjustable relative to said trigger to alter the point of contact between said trigger and said actuator.

* * * * *